United States Patent [19]

Russo et al.

[11] 3,940,024

[45] Feb. 24, 1976

[54] AEROSOL DISPENSING DEVICE

[75] Inventors: John A. Russo, Norwalk, Conn.; Mishel Greenberg, New Hyde Park, N.Y.

[73] Assignee: Chesebrough Pond's Inc., Greenwich, Conn.

[22] Filed: Aug. 14, 1974

[21] Appl. No.: 497,398

[52] U.S. Cl. ..... 222/182; 222/402.17; 239/51.5; 239/393

[51] Int. Cl.[2] ..... B67D 5/06

[58] Field of Search..... 222/394, 402.17, 182; 239/51.5, 52, 55–57, 393, 579

[56] References Cited

UNITED STATES PATENTS 3,330,481 7/1967 Dearling ..... 239/51.5

3,702,668 11/1972 Landen ..... 222/182

*Primary Examiner*—Allen N. Knowles

*Attorney, Agent, or Firm*—Morgan, Finnegan, Pine, Foley & Lee

[57] ABSTRACT

An absorbent strip of material is carried for movement between a blocking position and a clearance position relative to the discharge of a valve actuator to provide for prolonged evaporative dispensing or direct dispensing of aerosol product, such as room deodorizer, to the atmosphere. The absorbent strip is carried in an annular groove defined by a plurality of vertical ribs on a carrier member, which is rotatable for movement into and out of alignment with the discharge outlet.

6 Claims, 5 Drawing Figures

AEROSOL DISPENSING DEVICE

BACKGROUND OF THE INVENTION

This invention relates to aerosol devices, particularly aerosol devices designed for dispensing an air borne dispersant, such as a room deodorizer.

Aerosol containers are in common use today and have received wide acceptance among consumers. Such containers have been designed to dispense a wide variety of products for such purposes as adding a fragrance or deodorant to the air, dispensing insecticide, and administering inhalation medication.

Ordinarily these products are dispensed directly into the air by means of a push button actuator or the like which depresses the aerosol container valve and directs the product into the atmosphere. Depending on the type of product to be dispensed, it may be desirable to directly dispense the product into the air for high concentration or to more uniformly distribute the aerosol over a longer period of time. The prior art includes rudimentary devices which utilize an absorbent material or wick for prolonged evaporative dispersion of the aerosol product. However, none have the flexibility of dispersion desirable for products such as room deodorizers which are both directly dispensed and dispersed over a long period of time.

SUMMARY OF THE INVENTION

The present invention is designed for both direct dispersion of aerosol product into the atmosphere under the influence of propellant, or evaporative dispersion of aerosol product, which has been deposited on an absorbent material or wick. Accordingly, the aerosol device includes a base member which is detachably mounted on the top of an aerosol container. A valve actuator, such as the push button type, is slidably positioned within the base member and adapted to engage the valve stem and open the aerosol valve when depressed manually. A strip of absorbent material is carried in a carrier member which is rotatably mounted on the base. The carrier includes a plurality of ribs in which the absorbent material is positioned. The ends of the strip are spaced apart to form a direct spray zone therebetween so that the product may be directly dispensed, and, when rotated into position in front of the discharge outlet in the actuator, the strip is positioned to receive and absorb the dispensed product. Atmospheric air freely circulates between the ribs and around the strip to cause the absorbed product to evaporate and thus provide controlled, extended dispersion of the product.

DETAILED DESCRIPTION OF A PREFERRED EMBODIMENT

Figure 1:
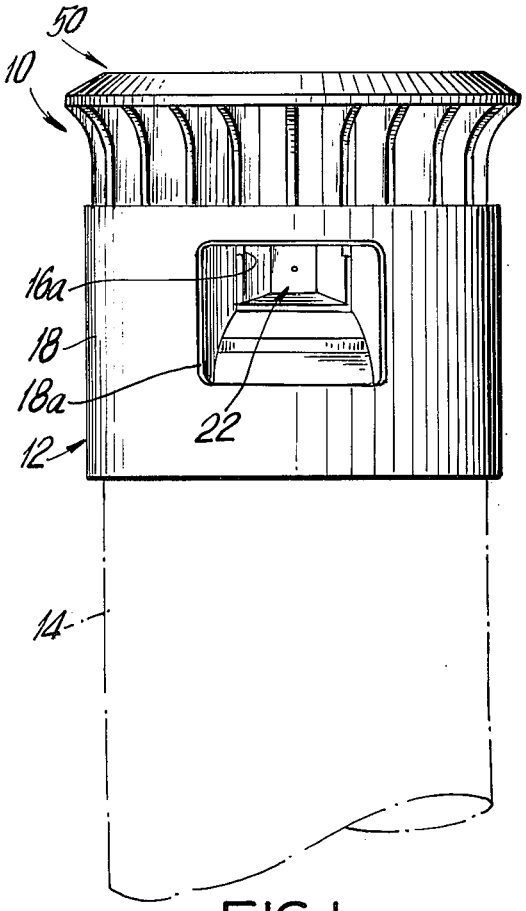
FIG. 1 is a front elevation view of an aerosol device in accordance with the present invention, illustrated in the direct dispensing position.
Figure 3:
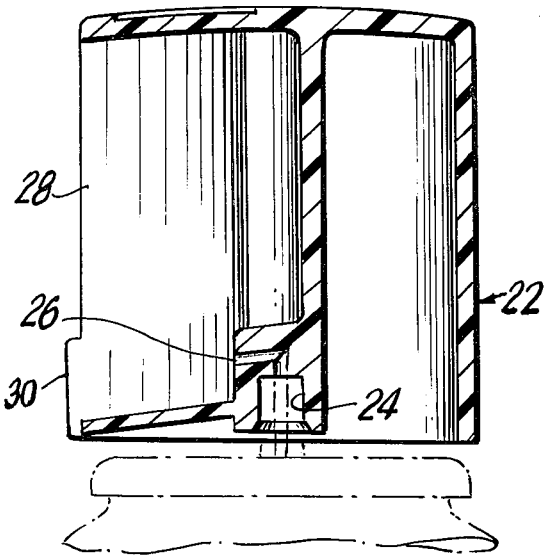
FIG. 3 is an enlarged sectional view taken along line 3—3 in FIG. 2.

While this invention is susceptible of embodiment in many different forms, there is shown in the drawings and will hereinafter be described in detail a preferred embodiment of the invention, with the understanding that the present disclosure is to be considered as an exemplification of the principles of the invention and is not intended to limit the invention to the embodiment illustrated.

Figure 2:
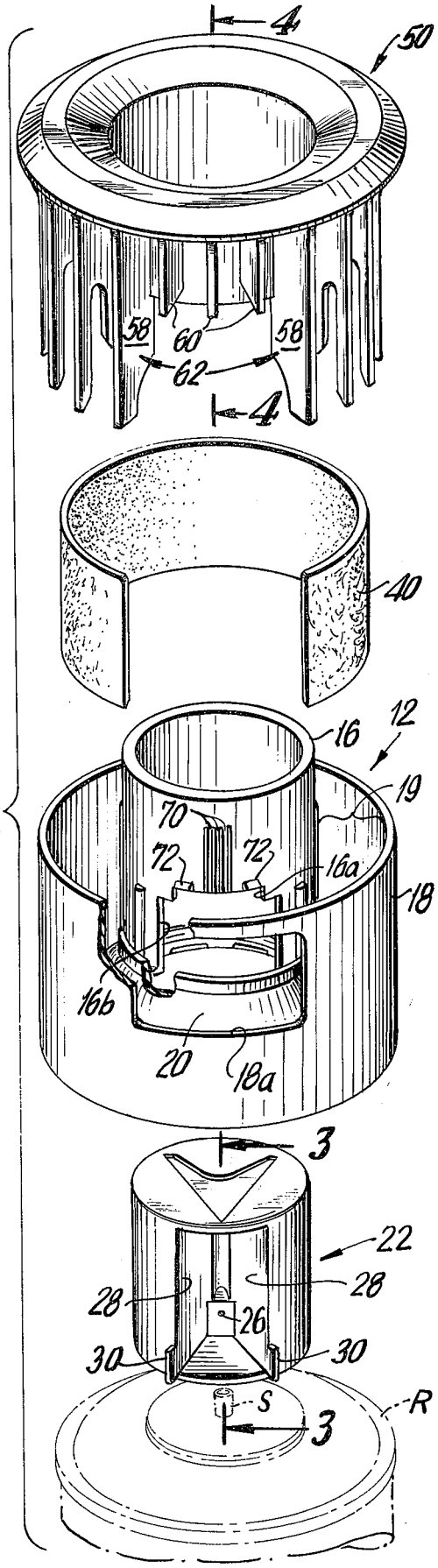
FIG. 2 is an exploded, perspective view with certain portions broken away for clarity of illustration showing the various elements of the aerosol device in FIG. 1.

FIGS. 1 and 2 show the aerosol dispensing device 10 in accordance with the present invention which includes a base 12 adapted to be detachably engaged with the upper end of an aerosol container 14. Base member 12 includes a vertical generally cylindrically shaped hub portion 16 and a generally cylindrically shaped wall portion 18 spaced radially outwardly from hub 16 to define a receiving area 19 therebetween, as will be described in greater detail below. Hub 16 and wall 18 are interconnected by means of a contoured bottom wall 20 to form an integral unit which may be conveniently formed for molding.

A valve actuator 22 is slidably positioned within hub portion 16. Actuator 22 is generally cylindrical in shape and includes a downwardly facing valve chamber 24 adapted to engage valve stem S of the container when depressed and a discharge passage 26. Passage 26 is in communication with the upper portion of chamber 24 at its inner end and extends generally radially outwardly to direct product to the exterior of the dispensing device. Referring particularly to FIG. 2, actuator 22 includes outwardly flared walls 28 on either sides of discharge outlet passage 26 which define a spray sector therebetween and merge smoothly with the cylindrical wall of the actuator.

As illustrated in FIGS. 1 and 2, actuator 22, is positioned for vertical sliding movement within hub portion 16 and is accessible through the top thereof so that the actuator may be manually depressed to engage valve stem S and unseat the container valve to dispense product therefrom. To permit product discharge, hub portion 16 and wall 18 each define aligned dispensing ports **16*a* and 18*a*, respectively, which are formed on common radii with flared walls 28. Actuator 22 is maintained in alignment with the base 18 within port 16*a* by vertical guide tracks 16*b*. Vertical lips 30 extend radially outwardly from the lower portion of the valve actuator 22 adjacent each of the walls 28 and ride in with tracks 16*b* to constrain actuator 22** for vertical movement only.

Figure 4:
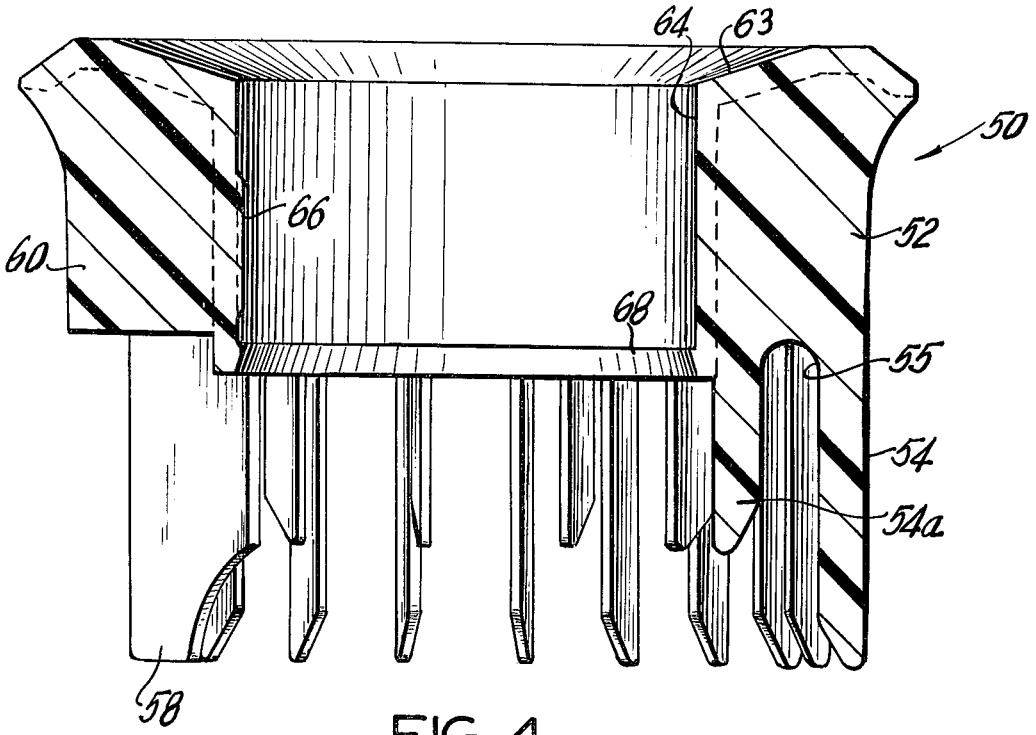
FIG. 4 is an enlarged sectional view taken along line 4—4 in FIG. 2.
Figure 5:
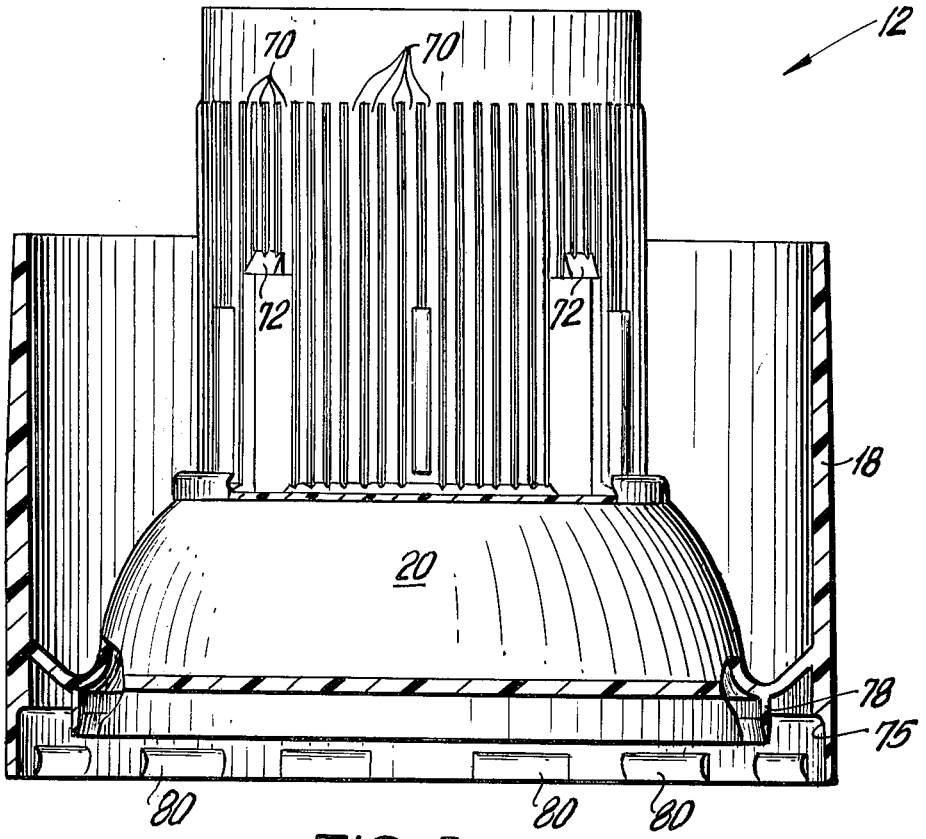
FIG. 5 is an enlarged sectional view with certain portions broken away for clarity of illustration showing the interior rearward configuration of the base member.

A strip of absorbent material 40, such as synthetic sponge, is carried in a carrier member 50. Strip 40 is generally rectangular in shape but other shapes may also be used. Carrier 50, FIG. 4, includes a plurality of radially extending, vertical ribs. 52. Ribs 52 are of three types: carrier ribs 54 which are bifurcated vertically at their lower central portion to define an annular strip carrying space 55; a pair of spray zone defining ribs 58, FIG. 2; and a set of truncated ribs 60. Ribs 58 are contoured at their lower portion to conform with the contour of base 20 and are designed to be positioned thereon. Carrier ribs 54 are tapered at their lower ends to facilitate insertion of strip 40 and are adapted to position the strip in spaced relationship with the hub portion 16 to provide a mixing zone corresponding in width to the width of the inner porton **54*a* of the rib. Ribs 58 cooperate with dispensing ports 16*a* and 18*a* to form a spray zone 62** for direct dispensing of the aerosol product to the atmosphere.

Ribs 54 are of sufficient height to extend above wall 18 and are interconnectd by an integral hub and cover portion 63. Portion 63 defines a bore 64 slightly larger in diameter than hub 16. A vertical tongue 66 and an annular snap ridge 68 are formed on the surface of bore 64 and cooperate with a plurality of vertical grooves 70 define on the exterior of hub portion 16 and snap-in ribs 72 formed at angularly spaced positions on the exterior of hub 16, respectively. In this manner as carrier 50 is moved into vertical register with base 18, rib 68 rides over rib portions 72 and becomes interlocked therewith to snap-fit carrier 50 on base 18 while permitting the carrier to be rotated angularly relative to the base. Tongue 66 cooperates with grooves 70 to provide a means for indexing the relative angular position between carrier 50 and base 18 so that carrier 50 may be positioned at any one of a plurality of positions relative to the base ranging from a direct dispensing position, as illustrated in FIG. 1, to an evaporative dispensing position wherein spray zone 62 is positioned diametrically opposite to spray ports 16 *a* and 18*a*. As illustrated, grooves 70 are formed between raised vertical portions 72 but could be formed by depressions in the surface of the hub portion. Base 18 includes an interior annular groove 75 adapted to engage the outer portion of the seal rim R of the aerosol container and an interior downwardly extending annular wall 78 adapted to be positioned on the interior portion of rim R. Additionally, a plurality of angularly spaced lugs 80 are formed on the interior surface of groove 75 to create a snap-fit of the base onto the top of the aerosol container.

To operate the aerosol room deodorizer, the carrier 50 is rotated within base 12 to provide either direct or prolonged dispensing of aerosol product. For directly dispensing a deodorizer into a room, carrier 50 is rotated until spray zone 62 is in registry with hub and wall ports 16*a* and 18*a*, respectively, and actuator 22 is depressed whereupon the aerosol dispersant is sprayed directly into the room. For prolonged dispensing carrier 50 is rotated until the absorbent strip 40 is in registry with ports 16*a* and 18*a*. Then when actuator 22 is depressed, the aerosol dispersant will be dispensed onto and into absorbent strip which then permits the deodorizer to evaporate as air circulates between the ribs 54 to provide prolonged dispersion. During such prolonged dispersion, the flow of air around the strip 40 is provided through the combination of port 18*a*, the mixing zone provided by rib portion 54*a*, and the extension of the ribs above the top of base 18. In this manner air freely circulates around the absorbent strip to provide evaporation of the dispersant.

Thus the present invention provides the flexibility of being capable of direct or prolonged dispensing of aerosol products. Others skilled in the art will be able to make modification to the invention without departing from the scope and spirit thereof as pointed out in the appended claims.

What is claimed is:

1. An aerosol dispensing device adapted for use with a pressurized aerosol container for direct and prolonged evaporative dispensing, said container having a dispensing valve extending upwardly therefrom, which comprises: a base member adapted to engage the top of said container, said base member including a vertically extending open ended hub portion and a cylindrical wall portion spaced radially outwardly from said hub portion to define an annular receiving area therebetween; a valve actuator slidably positioned coaxially within said hub portion, said actuator having a downwadly facing, valve engaging chamber and a discharge passage extending from said chamber radially outwardly to the exterior of said actuator; said hub portion and wall portions defining dispensing ports in radial alignment with the outlet end of said passage; means for preventing relative angular movement between said actuator and said dispensing ports; a carrier member defining a central bore adapted to receive said hub therein and having a plurality of angularly spaced apart, radial ribs extending downwardly into said receiving area, said ribs defining a sector spray zone and a complementary annular shaped carrier zone; a strip of absorbent material positioned in the carrier zone of the ribs; means for interlocking said carrier to said base member while permitting relative angular rotation therebetween, whereby said spray zone may be aligned with said ports for direct dispensing of the container product and said carrier may be rotated to position said absorbent material in front of said discharge passage for dispensing of product thereon and prolonged evaporation therefrom.

2. The aerosol device of claim 1, wherein said hub portion and said actuator are generally cylindrical in shape, and said means for preventing relative angular movement include a vertical guide track in said hub and a vertical, outwardly extending lip on said actuator positioned in said guide track.

3. The aerosol device of claim 1, wherein said carrier zone is spaced outwardly from said hub portion to provide a flow zone between said absorbent material strip and said hub portion.

4. The aerosol device of claim 1, wherein said hub portion defines a plurality of vertical grooves on the outer surface thereof and the carrier member defines a vertical inwardly extending tongue in said bore, said tongue being in interference fit with said grooves, whereby said carrier may be locked in a preselected angular position relative to said hub.

5. The aerosol device of claim 1, wherein said ribs extend beyond the top edge of said wall portion.

6. An aerosol dispensing device for direct and prolonged evaporative dispensing comprising: an aerosol container having a dispensing valve extending therefrom means for actuating said valve to dispense product from said container and for directing said product in a predetermined product path; a base member mounted on the top of said container, said base member including first and second upwardly extending tubular walls, the first tubular wall slidably supporting said actuator means; the second tubular wall being spaced radially outwardly of the first tubular wall, and said first and second tubular walls defining dispensing ports in radial alignment with said product path; an annular carrier member located between said first and second walls and mounted for angularly rotation therebetween; absorbent material carried by said carrier member between said first and second walls, said carrier and absorbent material defining a sector spray zone corresponding to said product path, whereby said product may be dispensed directly from said container to the atmosphere when said sector spray zone is aligned with said dispensing ports, or dispensed into said absorbent material for prolonged evaporative dispensing, when said carrier is rotated to place said absorbent material in said product path.

* * * * *